US005275147A

United States Patent [19]

Aktinson, III

[11] Patent Number: 5,275,147

[45] Date of Patent: Jan. 4, 1994

[54] GAS ELECTRIC RANGE APPARATUS

[76] Inventor: Benjamin E. Aktinson, III, 12591 SW. 6th Ct., Ft. Lauderdale, Fla. 33325

[21] Appl. No.: 36,357

[22] Filed: Mar. 24, 1993

[51] Int. Cl.[5] ..... F24C 3/00

[52] U.S. Cl. ..... 126/39 BA; 126/39 R; 392/310

[58] Field of Search ..... 126/39; 392/307, 309, 392/310

[56] References Cited

U.S. PATENT DOCUMENTS

| | | | |
|---|---|---|---|
| 2,463,712 | 3/1949 | Newell | 392/310 |
| 2,658,987 | 11/1953 | Ogden | 126/39 R |
| 3,423,568 | 1/1969 | Meckley, III et al. | 392/310 |
| 5,054,465 | 10/1991 | Chern | 126/39 BA |

FOREIGN PATENT DOCUMENTS

| | | | |
|---|---|---|---|
| 65834 | 5/1980 | Japan | 126/39 BA |
| 92824 | 7/1980 | Japan | 126/39 BA |

*Primary Examiner*—James C. Yeung
*Attorney, Agent, or Firm*—Leon Gilden

[57] ABSTRACT

A range structure is arranged to include a housing having a housing top wall, having a plurality of burner assemblies, with each burner assembly including a gas burner head mounting an annular electric cooking ring thereon. Each gas burner head includes an annular array of gas ports, as well as a plurality of support boss plugs projecting beyond the gas ports for support of an associated cooking ring. The baking cavity of the housing includes respective roof and floor plates having respective electric and gas members to permit the selective baking and broiling of food components in the baking cavity.

1 Claim, 4 Drawing Sheets

GAS ELECTRIC RANGE APPARATUS

BACKGROUND OF THE INVENTION

1. Field of the Invention

The field of invention relates to cooking apparatus, and more particularly pertains to a new and improved gas electric range apparatus wherein the same permits the selective employment of gas or electricity as a cooking fuel.

2. Description of the Prior Art

A gas electric range cooking structure is indicated in the prior art in U.S. Pat. No. 4,899,723, wherein a plurality of cooking heads are arranged with electric resistance elements contained therewithin.

U.S. Pat. No. 3,502,835 sets forth an electric switch structure for use in a gas range burner.

Employment of a dual fuel cooking structure is desirable in the prior art, particularly for use in recreational vehicle environments wherein typically propane gas is availed for cooking, but wherein electric energy is availed at various locations for use with a typical R.V., wherein upon availability of such electricity, the use of electricity as a cooking energy is desirable for convenience and versatility of the cooking structure and in this respect, the present invention substantially fulfills this need.

SUMMARY OF THE INVENTION

In view of the foregoing disadvantages inherent in the known types of cooking apparatus now present in the prior art, the present invention provides a gas electric range apparatus wherein the same permits the selective use of flammable gas or electricity as a cooking energy. As such, the general purpose of the present invention, which will be described subsequently in greater detail, is to provide a new and improved gas electric range apparatus which has all the advantages of the prior art cooking apparatus and none of the disadvantages.

To attain this, the present invention provides a range structure arranged to include a housing having a housing top wall, having a plurality of burner assemblies, with each burner assembly including a gas burner head mounting an annular electric cooking ring thereon. Each gas burner head includes an annular array of gas ports, as well as a plurality of support boss plugs projecting beyond the gas ports for support of an associated cooking ring. The baking cavity of the housing includes respective roof and floor plates having respective electric and gas members to permit the selective baking and broiling of food components in the baking cavity.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gas electric range apparatus which has all the advantages of the prior art cooking apparatus and none of the disadvantages.

It is another object of the present invention to provide a new and improved gas electric range apparatus which may be easily and efficiently manufactured and marketed.

It is a further object of the present invention to provide a new and improved gas electric range apparatus which is of a durable and reliable construction.

An even further object of the present invention is to provide a new and improved gas electric range apparatus which is susceptible of a low cost of manufacture with regard to both materials and labor, and which accordingly is then susceptible of low prices of sale to the consuming public, thereby making such gas electric range apparatus economically available to the buying public.

Still yet another object of the present invention is to provide a new and improved gas electric range apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
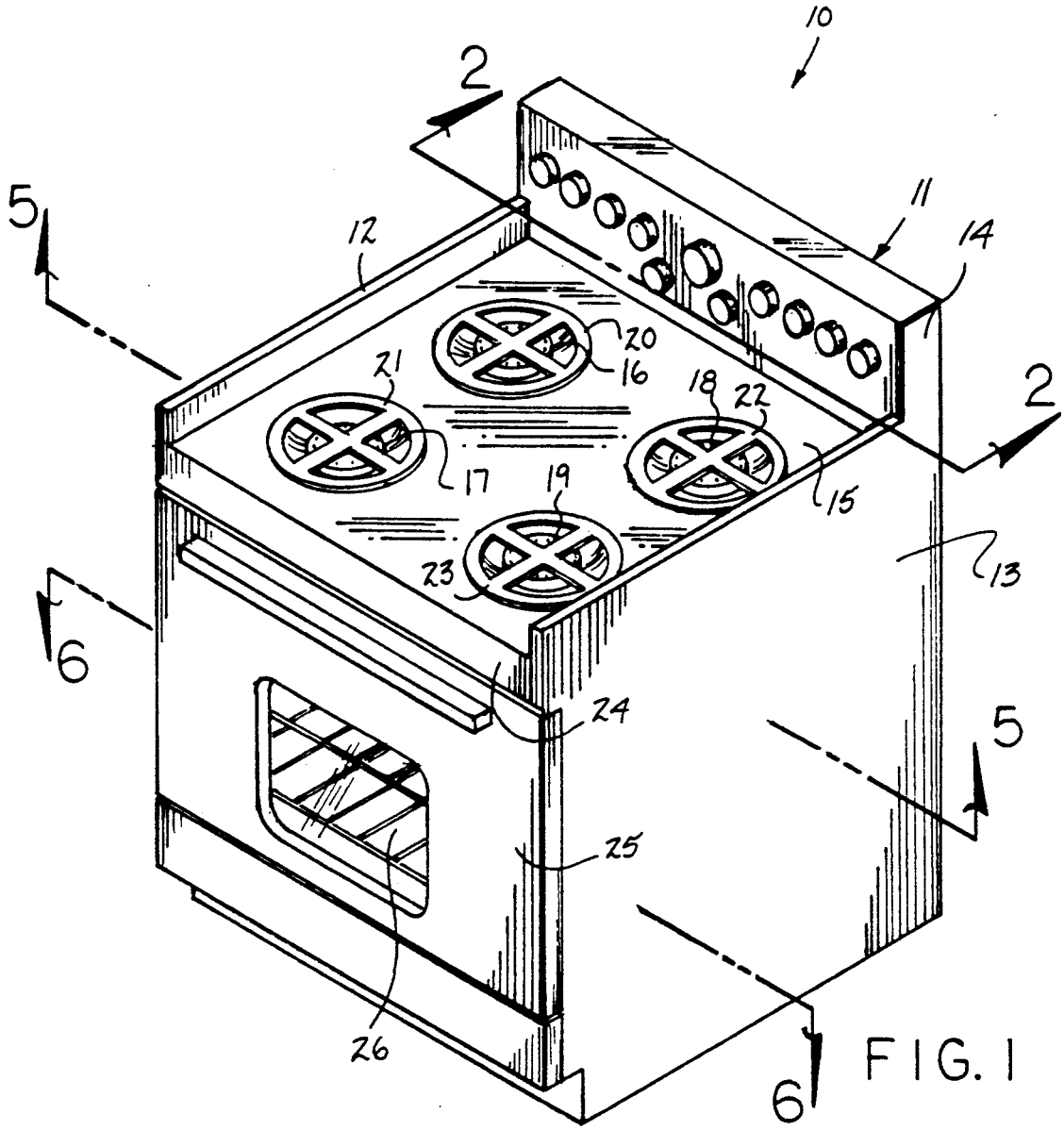
FIG. 1 is an isometric illustration of the invention.
Figure 2:
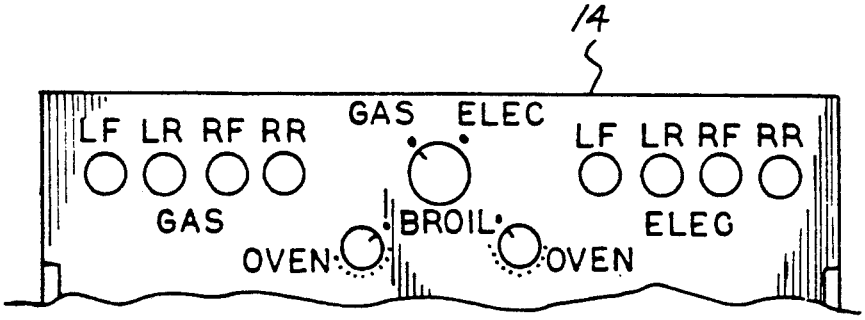
FIG. 2 is an orthographic view, taken along the lines 2—2 of FIG. 1 in the direction indicated by the arrows.
Figure 3:
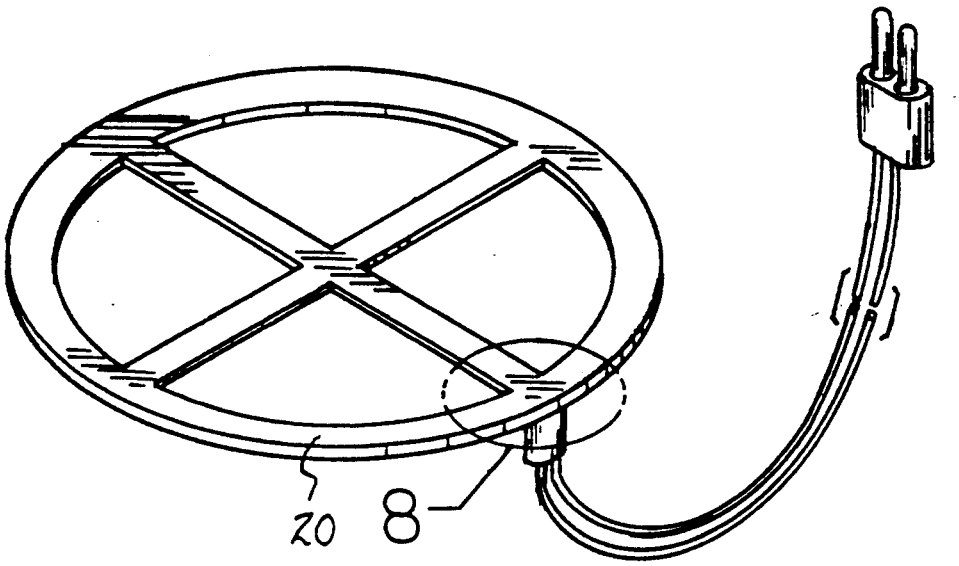
FIG. 3 is an isometric illustration of a typical electric cooking ring.
Figure 4:
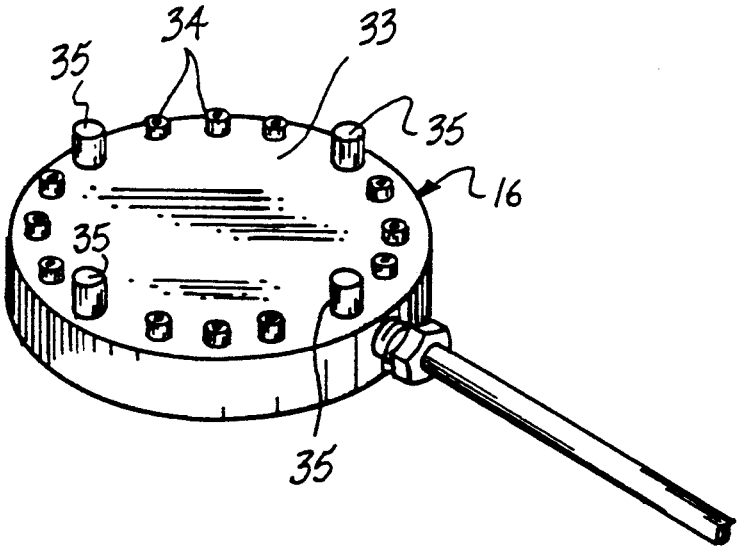
FIG. 4 is an isometric illustration of a gas burner head for mounting the electric cooking ring thereon
Figure 5:
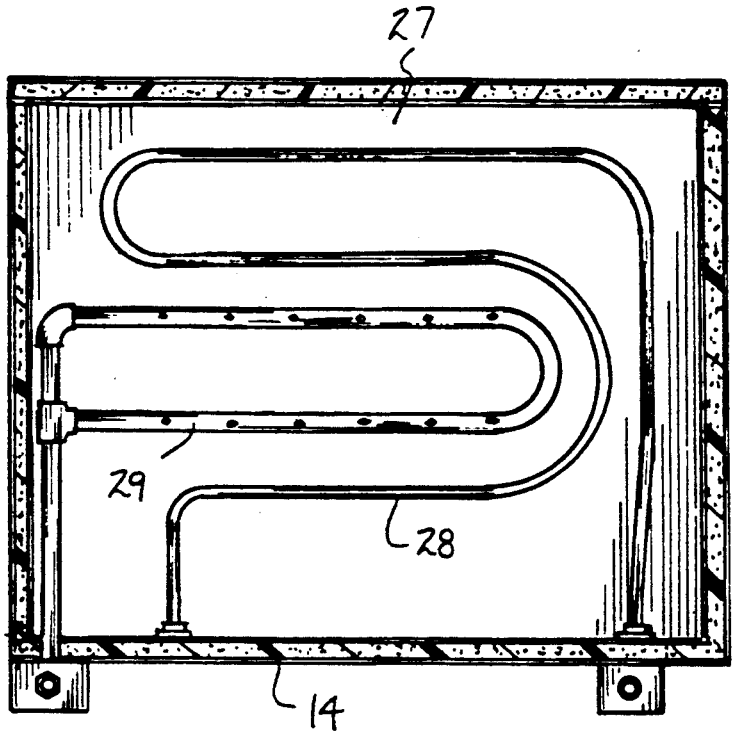
FIG. 5 is an orthographic view, taken along the lines 5—5 of FIG. 1 in the direction indicated by the arrows.
Figure 6:
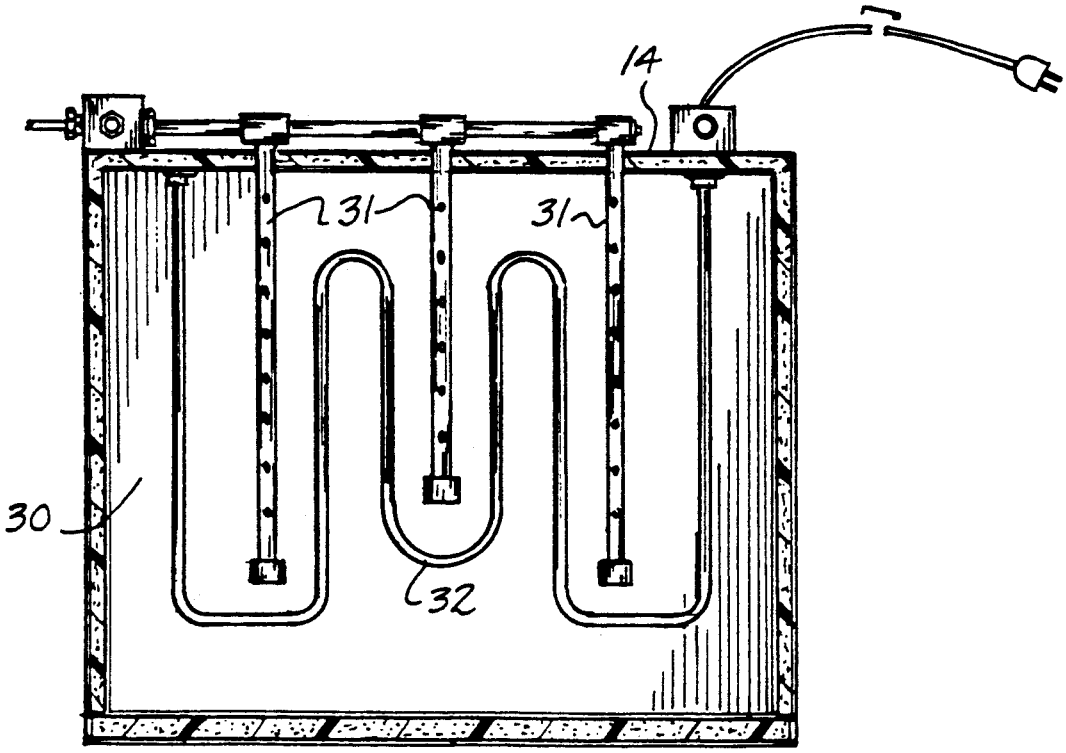
FIG. 6 is an orthographic view, taken along the lines 6—6 of FIG. 1 in the direction indicated by the arrows.
Figure 7:
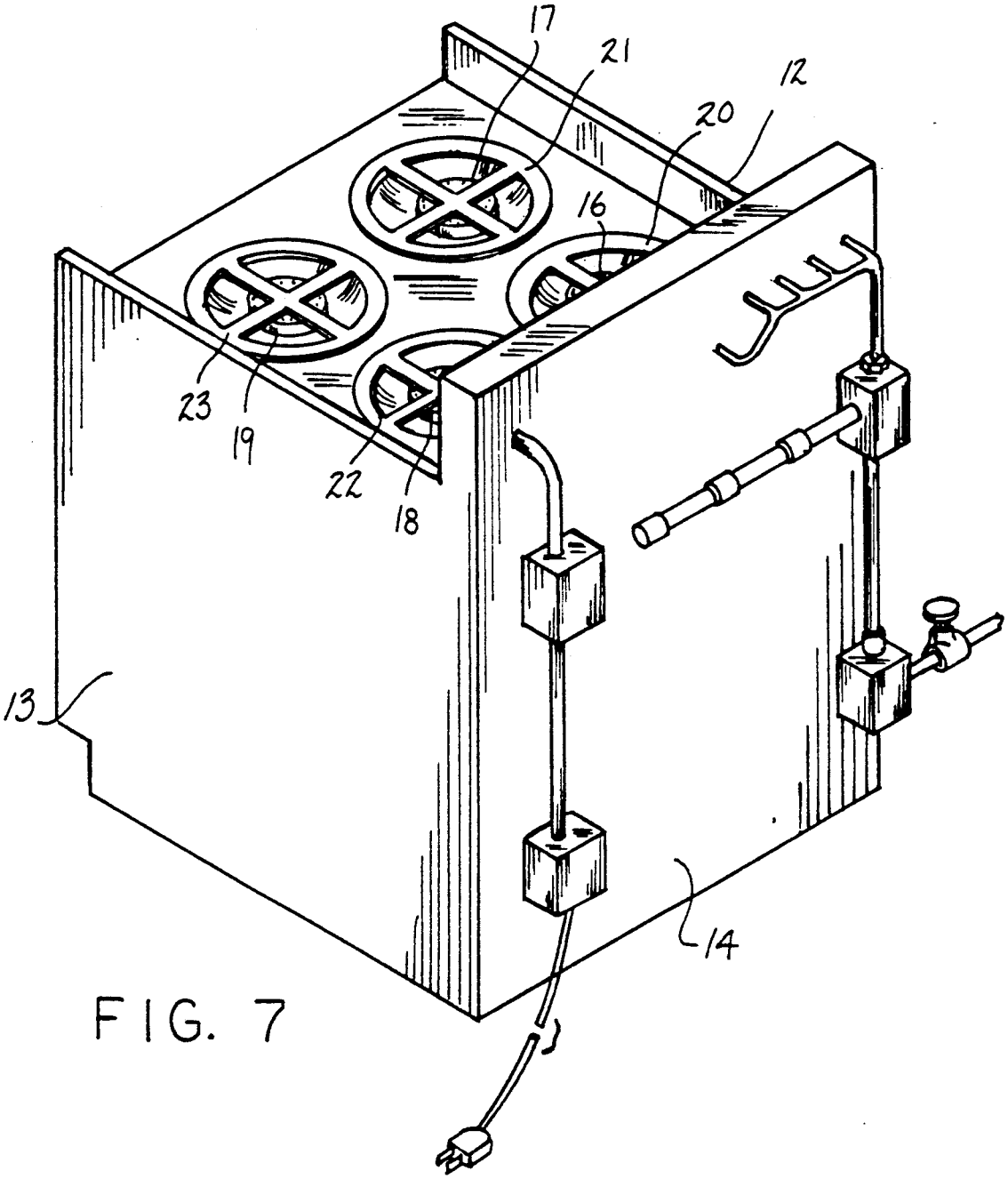
FIG. 7 is an isometric rear view of the invention.

With reference now to the drawings, and in particular to FIGS. 1 to 8 thereof, a new and improved gas electric range apparatus embodying the principles and concepts of the present invention and generally designated by the reference numeral 10 will be described.

More specifically, the gas electric range apparatus 10 of the invention essentially comprises a cooking range housing 11, having respective first and second side walls 12 and 13, a rear wall 14 projecting orthogonally above a cooking top wall 15, with a front wall 24 having a front wall door 25 accessed to a baking cavity 26 within the housing. A plurality of burner heads are provided recessed below the top wall, having respective first, second, third, and fourth gas burner heads 16, 17, 18, and 19 respectively. Each of the burner heads (see FIG. 4) includes a burner head top wall 33 having an annular array of gas ports 34 projecting orthogonally above the top wall, wherein spaced support boss plugs 36 project above the gas ports 34 in an annular array within the annular array of gas ports 34. In this manner, each of the burner heads 16–19 mounts a respective first through fourth annular cooking ring 20, 21, 22, and 23 respectively. In this manner, the burner rings are arranged in a spaced orientation above the gas ports in use. Electrical communication of the cooking rings 20–23 and pneumatic communication of the burner heads 16–19 are provided in a conventional manner operative through conventional controls arranged for positioning upon the rear wall 14 projecting above the top wall 15.

The baking cavity 26 includes a roof plate 27 spaced from and parallel a floor plate 30, wherein the roof plate 27 includes an electrical resistance broiling coil 28 (see FIG. 5) wound about a first apertured gas conduit 29, with the gas conduit 29 and the electrical resistance broiling coil 28 arranged in a substantially coplanar relationship parallel to the roof plate 27. Positioned in parallel adjacency to the floor plate 30 are a plurality of parallel apertured gas conduits 31 arranged at an equal distance relative to one another, having an electrical resistance broiling coil 32 directed thereabout.

Figure 8:
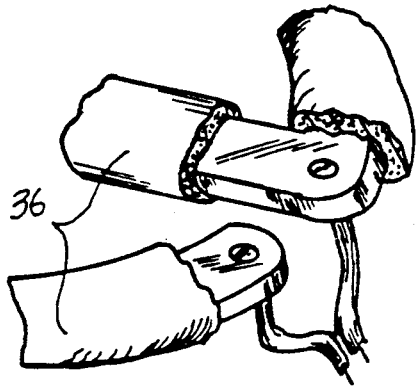
FIG. 8 is an enlarged isometric illustration of section 8 as set forth in FIG. 3.

Further as indicated in FIG. 8, it should be noted that ceramic coatings 36 are employed by the electrical interconnection of the electrical connections to the cooking rings for safety and longevity in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A gas electric range apparatus, comprising, cooking range housing, having a first side wall spaced from a second side wall, a rear wall spaced from a front wall, and a top wall, with the front wall having a front wall door pivotally mounted to the front wall, with a baking cavity positioned within the housing accessed through the front door, and a plurality of cooking members mounted onto the top wall, wherein each of the cooking members includes a gas burner head recessed below the top wall, and each gas burner head includes an electric cooking ring mounted thereon, and each said gas burner head includes a burner head top wall, wherein each burner head top wall includes an annular array of gas ports, and within the annular array of gas ports are positioned a plurality of support boss plugs in a spaced relationship, wherein the support boss plugs and the gas ports are arranged in a single annular array, and the support boss plugs project above the gas ports relative to the burner head top wall, and said electric cooking ring is positioned upon said support boss plug, and the baking cavity includes a cavity floor plate and a cavity roof plate, and in a parallel relationship to the cavity roof plate is an electrical resistance broiling coil of a serpentine configuration, with a first apertured gas conduit, with the first apertured gas conduit and the electrical resistance broiling coil arranged in a coplanar relationship parallel to the roof plate, with the cavity floor plate having a plurality of parallel second apertured gas conduits, wherein the second apertured gas conduits include an electrical resistance baking coil wound about the second apertured gas conduits, wherein the electrical resistance baking coil and the second apertured gas conduits are arranged in a parallel coplanar relationship relative to the cavity floor plate.

* * * * *